US008851638B2

(12) United States Patent
Ellinger

(10) Patent No.: US 8,851,638 B2
(45) Date of Patent: Oct. 7, 2014

(54) MULTIPLE RESOLUTION CONTINUOUS INK JET SYSTEM

(75) Inventor: Carolyn R. Ellinger, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 836 days.

(21) Appl. No.: 12/944,186

(22) Filed: Nov. 11, 2010

(65) Prior Publication Data

US 2012/0120163 A1 May 17, 2012

(51) Int. Cl.

| | |
|---|---|
| ***B41J 2/07*** | (2006.01) |
| ***B41J 2/505*** | (2006.01) |
| *B41J 2/02* | (2006.01) |
| *B41J 2/03* | (2006.01) |

(52) U.S. Cl.

CPC ..... *B41J 2/03* (2013.01); *B41J 2002/022* (2013.01); *B41J 2002/031* (2013.01); *B41J 2002/033* (2013.01); *B41J 2/5056* (2013.01); *B41J 2002/032* (2013.01); *B41J 2202/16* (2013.01)

USPC ..... 347/74

(58) Field of Classification Search

None

See application file for complete search history.

(56) References Cited

U.S. PATENT DOCUMENTS

| | | | |
|---|---|---|---|
| 4,827,285 A | 5/1989 | Kolb | |
| 5,788,385 A | 8/1998 | Inoue et al. | |
| 6,079,821 A | 6/2000 | Chwalek et al. | |
| 6,419,336 B1 | 7/2002 | Takahashi | |
| 6,457,807 B1 | 10/2002 | Hawkins et al. | |
| 6,491,362 B1 | 12/2002 | Jeanmaire | |
| 6,505,921 B2 | 1/2003 | Chwalek et al. | |
| 6,554,410 B2 | 4/2003 | Jeanmarie et al. | |
| 6,575,566 B1 | 6/2003 | Jeanmarie et al. | |
| 6,588,888 B2 | 7/2003 | Jeanmarie et al. | |
| 6,793,328 B2 | 9/2004 | Jeanmarie | |
| 6,827,429 B2 | 12/2004 | Jeanmarie et al. | |
| 6,851,796 B2 | 2/2005 | Jeanmarie et al. | |
| 7,249,829 B2 | 7/2007 | Hawkins et al. | |
| 7,758,171 B2 * | 7/2010 | Brost | 347/75 |

FOREIGN PATENT DOCUMENTS

| | | |
|---|---|---|
| EP | 013 296 | 10/1979 |
| EP | 692 386 A1 | 1/1996 |
| EP | 925 924 | 6/1999 |
| WO | 2006/124747 | 11/2006 |

OTHER PUBLICATIONS

F.R.S. (Lord) Rayleigh, "Instability of Jets", Proc. London Math. Soc. 10 (4), 1878.

H.C. Lee, "Drop Formation in a Liquid Jet", IBM Journal of Research and Development, Jul. 1974, pp. 364-369.

* cited by examiner

*Primary Examiner* — Jerry Rahll

(74) *Attorney, Agent, or Firm* — Nelson Adrian Blish

(57) ABSTRACT

A continuous ink jet printing system capable of printing at multiple predetermined print resolutions. The system comprises a drop generator having an array of nozzles for emitting a plurality of continuous streams of liquid for applying ink to media driven in a media advance direction having a source for pressurized liquid for supplying pressurized liquid to the plurality of nozzles. The plurality of nozzles have effective nozzle diameters $D_0$ and a stimulation device associated with each nozzle of the plurality of nozzles for forming ink drops having predetermined drop volumes from the continuous streams of liquid. The predetermined drop volumes include non-print drops of a unit volume $V_0$, and print drops having volumes that are integer multiples of the unit volume, $mV_0$, wherein m is an integer greater than 1. A catcher collects the non-print drops and a selector selects a predetermined print resolution. Each predetermined print resolution has a corresponding print drop volume $mV_0$.

19 Claims, 9 Drawing Sheets

MV0 (PL)

MULTIPLE RESOLUTION CONTINUOUS INK JET SYSTEM

FIELD OF THE INVENTION

This invention relates generally to the field of digitally controlled printing devices, and in particular to continuous ink jet systems capable of printing at multiple resolutions.

BACKGROUND OF THE INVENTION

Ink jet printing has become recognized as a prominent contender in the digitally controlled, electronic printing arena because of its non-impact, low-noise characteristics, its use of plain paper, and its avoidance of toner transfer and fixing. Other applications, requiring very precise, non-contact liquid pattern deposition, may be served by drop emitters having similar characteristics to very high resolution ink jet printheads. By very high resolution liquid layer patterns, it is meant, herein, patterns formed of pattern cells (pixels) having spatial densities of at least 300 per inch in two dimensions.

Ink jet printing mechanisms can be categorized by technology as either drop-on-demand ink jet or continuous ink jet. The first technology, "drop-on-demand" ink jet printing, provides ink droplets that impact upon a recording surface by using a pressurization actuator (thermal, piezoelectric, etc.). Many commonly practiced drop-on-demand technologies use thermal actuation to eject ink droplets from a nozzle. A heater, located at or near the nozzle, heats the ink sufficiently to boil, forming a vapor bubble that creates enough internal pressure to eject an ink droplet. Other well known drop-on-demand droplet ejection mechanisms include piezoelectric actuators.

Drop-on-demand drop emitter systems are limited in the drop repetition frequency that is sustainable from an individual nozzle. In order to produce consistent drop volumes and to counteract front face flooding, the ink supply is typically held at a slightly negative pressure. The time required to re-fill the drop generation chambers and passages, including some settling time, limits the drop repetition frequency. Drop repetition frequencies ranging up to ~50 kHz may be possible for drops having volumes of 10 picoLiters (pL) or less. However, a drop frequency maximum of 50 KHz limits the usefulness of drop-on-demand emitters for high quality patterned layer deposition to process speeds below ~0.5 msec.

The second ink jet technology, commonly referred to as "continuous" ink jet (CIJ) printing, uses a pressurized ink source that produces a continuous stream of ink droplets from a nozzle. The stream is perturbed in some fashion causing it to break up into uniformly sized drops at a nominally constant distance, the break-off length, from the nozzle. Since the source of pressure is remote from the nozzle (typically a pump is used to feed pressurized ink to the printhead), the space occupied by the nozzles is very small. CIJ drop generators do not have a "refill" limitation since the drop formation process occurs after ejection from the nozzle, and thus can operate at frequencies approaching a megahertz.

CIJ drop generators rely on the physics of an unconstrained fluid jet, first analyzed in two dimensions by F. R. S. (Lord) Rayleigh, "Instability of jets," Proc. London Math. Soc. 10 (4), published in 1878. Lord Rayleigh's analysis showed that liquid under pressure, P, will stream out of a hole, the nozzle, forming a jet of diameter, $D_j$, moving at a velocity, $v_j$. The jet diameter, $D_j$, is approximately equal to the effective nozzle diameter, $D_n$, and the jet velocity is proportional to the square root of the reservoir pressure, P. Rayleigh's analysis showed that the jet will naturally break up into drops of varying sizes based on surface waves that have wavelengths, $\lambda$, longer than $\pi D_j$, i.e. $\lambda \geq \pi D_j$. Rayleigh's analysis also showed that particular surface wavelengths would become dominate if initiated at a large enough magnitude, thereby "stimulating" the jet to produce mono-sized drops. Individual CU drop generators or low density arrays of CIJ drop generators may be configured to produce the 100's of 1000's of small (<50 pL) drops per second per nozzle, which is one of the requirements needed for high quality patterned layered deposition process speeds above 0.5 msec.

Thermally stimulated CU devices may be fabricated using emerging microelectromechanical (MEMS) fabrication methods and materials. By applying microelectronic fabrication process accuracies to the construction of a thermally stimulated CIJ drop emitter, a liquid pattern deposition apparatus may be provided having a wide range of resolution and process speed capabilities. The physical parameters relating to continuous stream drop formation are constrained within certain boundaries to ensure the capability of providing a desired combination of pattern resolution, grey scale, drop volume uniformity, minimization of mist and spatter, and process speed. Such an apparatus has application for very high speed, photographic quality printing as well as for manufacturing applications requiring the non-contact deposition of high precision patterned liquid layers.

Ink jet printing systems that are capable of printing at different resolutions are known in the market. Such printing systems allow the user to select whether to print in a high quality mode at one print resolution at a certain print speed or in a lower quality mode at a lower print resolution at a higher print speed. Typically the lower quality mode, sometimes referred to as a draft mode, increases the spacing between pixels while printing with the same size drops. As a result, the print quality is reduced not only by the resolution reduction, but also by the lower ink coverage. There are some drop-on-demand (DOD) printing systems in which larger ink drops are used for the printing at the lower resolution to produce similar ink coverage levels in both the high and low quality print modes. A need exists to have a continuous ink jet system capable of printing quality prints at multiple resolutions. A system capable of printing at multiple resolutions needs to have a method for adjusting the spot size on paper to achieve the correct ink laydown and coverage for each of the resolutions.

There are documented systems which print at multiple resolutions using DOD technologies. In one example, as described in European Patent No. 0692386 (Onishi et al.) print using a fixed print droplet volume from a DOD ink jet device. In order to achieve multiple resolutions, ink media pairs are chosen such that the repellency of the ink on the media controls the diameters of the ink dots to the proper size. With this approach to multiple resolution printing, there is no flexibility for ink media selection, and it would be difficult to make quality prints at multiple resolutions on a single media type. U.S. Pat. No. 6,419,336 (Takahashi) describes another system capable of printing at multiple resolutions. In this second example, the volume of print drops formed is varied using a peizo system DOD, and is independently controlled. However, as a DOD technology it is fundamentally limited in the frequency at which drops can be made, thereby limiting the attainable process speeds.

In commonly-assigned U.S. Pat. No. 7,249,829 (Hawkins et al.) describes a drop deposition apparatus capable of forming drops of predetermined volumes having a unit volume, $V_0$, and drops having volumes that are integer multiples of the unit volume $mV_0$ using a continuous ink jet system. The disclosure is related to gray level printing, and does not address the problems associated with using drops of $mV_0$ increments in a multiple resolution continuous printing system.

The need exists for a continuous ink jet system capable of printing high quality images at multiple resolutions at fast process speeds.

SUMMARY OF THE INVENTION

Briefly, according to one aspect of the present invention a continuous ink jet printing system capable of printing at multiple predetermined print resolutions is disclosed. The system comprises a drop generator having an array of nozzles for emitting a plurality of continuous streams of liquid for applying ink to media driven in a media advance direction having a source for pressurized liquid for supplying pressurized liquid to the plurality of nozzles, wherein the plurality of nozzles have effective nozzle diameters $D_0$ and a stimulation device associated with each nozzle of the plurality of nozzles for forming ink drops having predetermined drop volumes from the continuous streams of liquid, wherein the predetermined drop volumes include non-print drops of a unit volume $V_0$, and print drops having volumes that are integer multiples of the unit volume, $mV_0$, wherein m is an integer greater than 1; a catcher to collect the non-print drops; and a selector for selecting a predetermined print resolution, wherein each predetermined print resolution has a corresponding print drop volume $mV_0$.

It is an advantage of the present invention that it provides an apparatus capable of printing images having different resolutions within a single system. The apparatus and method of the present invention allows the user to select predetermined resolutions and print speed combinations that were not previously achievable with a single continuous ink jet system, providing the user greater print job flexibility and lower overall equipment costs.

These and other objects, features, and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

In the detailed description of the example embodiments of the invention presented below, reference is made to the accompanying drawings, in which.

DETAILED DESCRIPTION OF THE INVENTION

Figure 1:
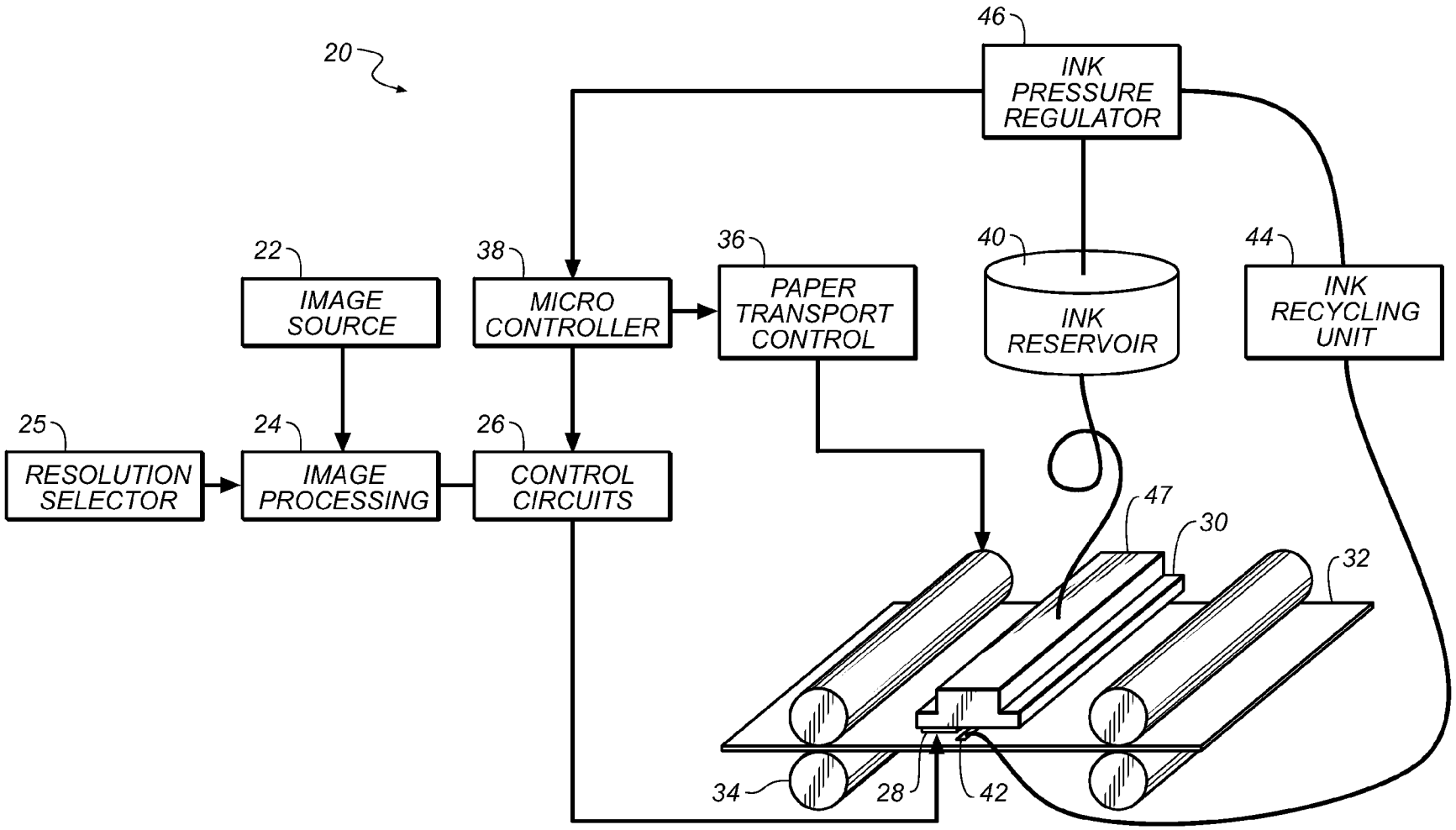
FIG. 1 shows a simplified schematic block diagram of an example embodiment of a printing system made in accordance with the present invention.

The present description will be directed in particular to elements forming part of, or cooperating more directly with, apparatus in accordance with the present invention. It is to be understood that elements not specifically shown or described may take various forms well known to those skilled in the art. In the following description and drawings, identical reference numerals have been used, where possible, to designate identical elements.

The example embodiments of the present invention are illustrated schematically and not to scale for the sake of clarity. One of the ordinary skills in the art will be able to readily determine the specific size and interconnections of the elements of the example embodiments of the present invention.

As described herein, the example embodiments of the present invention provide a printhead or printhead components typically used in ink jet printing systems. However, many other applications are emerging which use ink jet printheads to emit liquids (other than inks) that need to be finely metered and deposited with high spatial precision. As such, as described herein, the terms "liquid" and "ink" refer to any material that can be ejected by the printhead or printhead components described below. Referring to FIG. 1, a multiple resolution continuous printing system 20 includes an image source 22 such as a scanner or computer which provides raster image data, outline image data in the form of a page description language, or other forms of digital image data. This image data is converted to half-toned bitmap image data by an image processing unit 24 which also stores the image data in memory. A resolution selector 25 for selecting a predetermined print resolution in the media advance direction (also referred to as scan direction) communicates the output resolution requirements to the image processing unit 24. Resolution selector 25 may be a user interface, or be internal to the system whereby the print optimal resolution is chosen based on the available predetermined print resolutions and the content of the image source 22. A plurality of drop forming mechanism control circuits 26 read data from the image memory and apply time-varying electrical pulses to a drop forming mechanism(s) 28 that are associated with one or more nozzles of a printhead 30. These pulses are applied at an appropriate time, and to the appropriate nozzle, so that drops formed from a continuous ink jet stream will form spots (not shown) on a recording medium 32 in the appropriate position designated by the data in the image memory. The pulses are applied in a manner such that the volume of the print drops formed result in spots of the appropriate size for the selected resolution. As used herein appropriate sized spots for a given system and ink-media pair may be defined as spots which leave no portion of the recording media uncovered when printing image areas requiring 100% coverage. Correspondingly, appropriately sized spots may be said to leave no unwanted "white" space when printing 100% fill areas. In some instances lower quality images may be acceptable, therefore dots useful in the present invention are those which yield a solid fill image area having less that 2% unwanted "white" space.

Recording medium 32 is moved relative to printhead 30 by a recording medium transport system 34, which is electronically controlled by a recording medium transport control system 36, and which in turn is controlled by a micro-controller 38. The recording medium transport system shown in FIG. 1 is a schematic only, and many different mechanical configurations are possible. For example, a transfer roller could be used as recording medium transport system 34 to facilitate transfer of the ink drops to recording medium 32. Such transfer roller technology is well known in the art. In the case of page width printheads, it is most convenient to move recording medium 32 past a stationary printhead. However, in the case of scanning print systems, it is usually most convenient to move the printhead along one axis (the sub-scanning direction) and the recording medium along an orthogonal axis (the main scanning direction, or scan direction) in a relative raster motion.

The process speed of the multiple resolution continuous ink jet system 20 shown in FIG. 1 is equivalent to the recording media speed controlled by medium transport system 34. As used herein, the process speed is taken to mean the speed at which a print is made in a system. For single pass systems where the media transport is in a single direction, and the media makes one "pass" under the printheads, the process speed is equivalent to the media speed. In the case of multi-pass systems, where the media is addresses a single printhead multiple times, the process speed is the speed based on the media entering and leaving the system; typically multi-pass system process speeds are equal to the media speed divided by the number of passes. In both cases, as used herein media speed may also be referred to as the print speed.

Ink is contained in an ink reservoir 40 under pressure. In the non-printing state, continuous ink jet drop streams are unable to reach recording medium 32 due to an ink catcher 42 that blocks the stream and which may allow a portion of the ink to be recycled by an ink recycling unit 44. The ink recycling unit reconditions the ink and feeds it back to reservoir 40. Such ink recycling units are well known in the art. The ink pressure suitable for optimal operation will depend on a number of factors, including geometry and thermal properties of the nozzles and thermal properties of the ink. A constant ink pressure can be achieved by applying pressure to ink reservoir 40 under the control of ink pressure regulator 46. Alternatively, the ink reservoir can be left unpressurized, or even under a reduced pressure (vacuum), and a pump is employed to deliver ink from the ink reservoir under pressure to the printhead 30. In such an embodiment, the ink pressure regulator 46 can comprise an ink pump control system. As shown in FIG. 1, catcher 42 is a type of catcher commonly referred to as a "knife edge" catcher.

The ink is distributed to printhead 30 through an ink channel 47. The ink preferably flows through slots or holes etched through a silicon substrate of printhead 30 to its front surface, where a plurality of nozzles and drop forming mechanisms, for example, heaters, are situated. When printhead 30 is fabricated from silicon, drop forming mechanism control circuits 26 can be integrated with the printhead. Printhead 30 also includes a deflection mechanism (not shown in FIG. 1) which is described in more detail below with reference to FIGS. 2 and 3.

Figure 2:
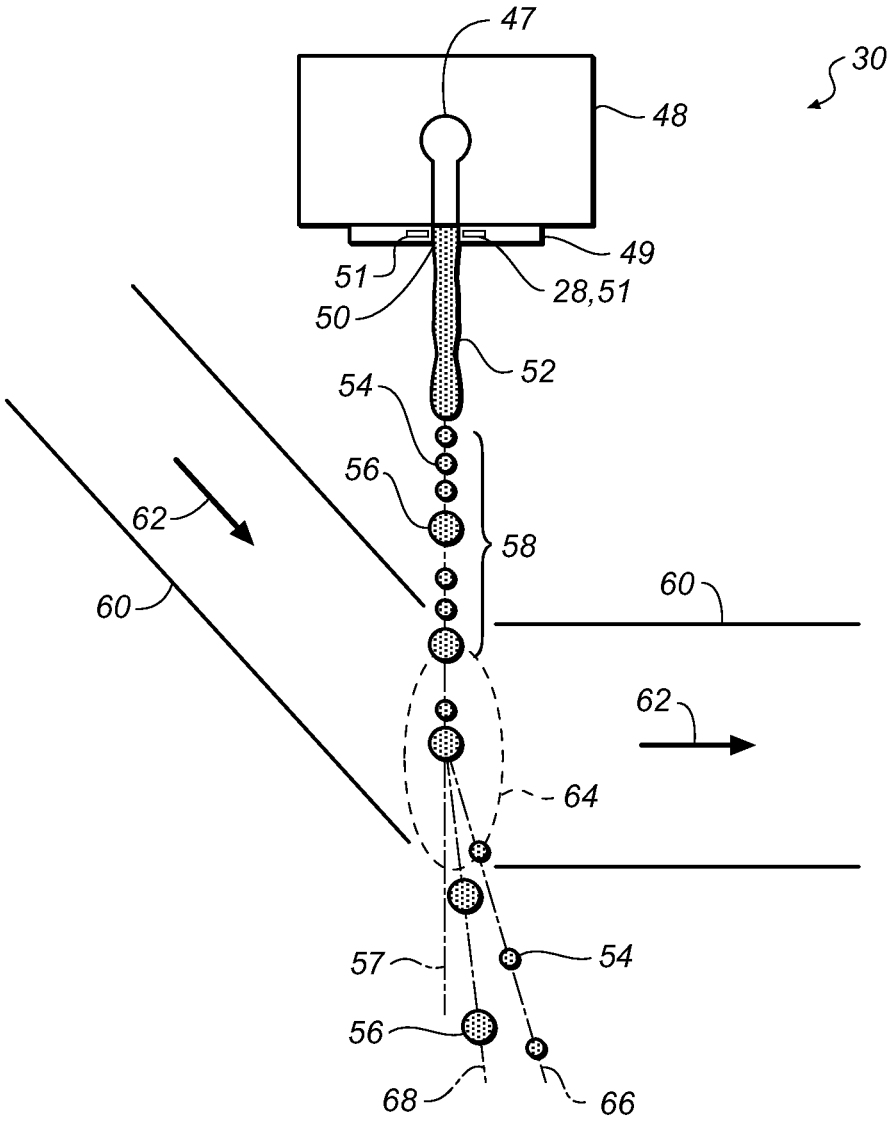
FIG. 2 is a schematic view of an example embodiment of a continuous printhead made in accordance with the present invention.
Figure 3:
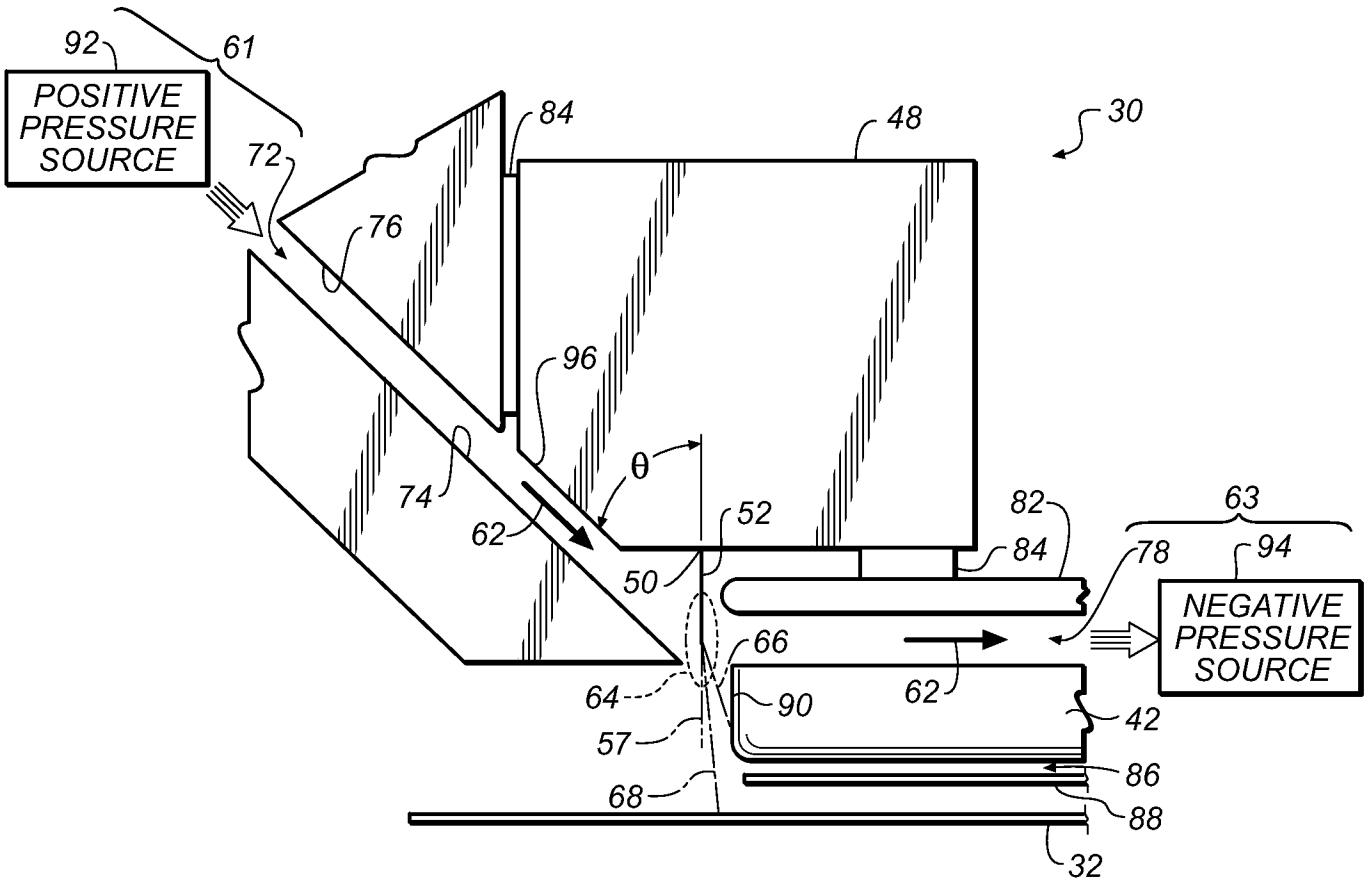
FIG. 3 is a schematic view of an example embodiment of a continuous printhead made in accordance with the present invention.

Referring to FIG. 2, a schematic view of continuous liquid printhead 30 is shown. A jetting module 48 of printhead 30 includes an array or a plurality of nozzles 50 formed in a nozzle plate 49. In FIG. 2, nozzle plate 49 is affixed to jetting module 48. However, as shown in FIG. 3, nozzle plate 49 can be integrally formed with jetting module 48.

Liquid, for example, ink, is emitted under pressure through each nozzle 50 of the array to form filaments of liquid 52. In FIG. 2, the array or plurality of nozzles extends into and out of the figure.

Jetting module 48 is operable to form liquid drops having a first size or volume and liquid drops having a second size or volume through each nozzle. To accomplish this, jetting module 48 includes a drop stimulation or drop forming device 28, for example, a heater or a piezoelectric actuator, that, when selectively activated, perturbs each filament of liquid 52, for example, ink, to induce portions of each filament to breakoff from the filament and coalesce to form drops 54, 56.

In FIG. 2, drop forming device 28 is a heater 51, for example, an asymmetric heater or a ring heater (either segmented or not segmented), located in a nozzle plate 49 on one or both sides of nozzle 50. This type of drop formation is known and has been described in, for example, U.S. Pat. No. 6,457,807 (Hawkins et al.); U.S. Pat. No. 6,491,362 (Jeanmaire); U.S. Pat. No. 6,505,921 (Chwalek et al.); U.S. Pat. Nos. 6,554,410, 6,575,566, 6,588,888, 6,827,429, 6,851,796 (all to Jeanmaire et al.); and U.S. Pat. No. 6,793,328 (Jeanmaire).

Typically, one drop forming device 28 is associated with each nozzle 50 of the nozzle array. However, a drop forming device 28 can be associated with groups of nozzles 50 or all of nozzles 50 of the nozzle array.

When printhead 30 is in operation, drops 54, 56 are typically created in a plurality of sizes or volumes, for example, in the form of large drops 56, a first size or volume, and small drops 54, a second size or volume. The ratio of the mass of the large drops 56 to the mass of the small drops 54, herein referred to as print drop ratio, is typically approximately an integer between 2 and 10. A drop stream 58 including drops 54, 56 follows a drop path or trajectory 57. The multiple resolution continuous printing system 20 is capable of operating at multiple print drop ratios, resulting in the generation of print drops 56 that are integer (m) multiples of the volume of drop 54. These drop volumes $mV_0$ correspond to the predetermined print resolutions.

Printhead 30 also includes a gas flow deflection mechanism 60 that directs a flow of gas 62, for example, air, past a portion of the drop trajectory 57. This portion of the drop trajectory is called the deflection zone 64. As the flow of gas 62 interacts with drops 54, 56 in deflection zone 64 it alters the drop trajectories. As the drop trajectories pass out of the deflection zone 64 they are traveling at an angle, called a deflection angle, relative to the undeflected drop trajectory 57.

Small drops 54 are more affected by the flow of gas than are large drops 56 so that the small drop trajectory 66 diverges from the large drop trajectory 68. That is, the deflection angle for small drops 54 is larger than for large drops 56. The flow of gas 62 provides sufficient drop deflection and therefore sufficient divergence of the small and large drop trajectories so that catcher 42 (shown in FIGS. 1 and 3) can be positioned to intercept the small drop trajectory 66 so that the small drops 54 drops are collected by catcher 42 while drops following the large drop trajectory 68 bypass the catcher and impinge a recording medium 32 (shown in FIGS. 1 and 3). Operating in large drop print mode, catcher 42 is positioned to intercept small drop trajectory 66, and the large drops 56 are the drops that print. The gas flow deflection mechanism 60 of the present invention is adapted to work with multiple print drop volumes. In one embodiment, the operating parameters, for example the air flow rates in first gas flow duct 72 and the flow rate in the second gas flow duct 78, of the deflection mechanism 60 are adjusted based on the selected predetermined print resolution and therefore the volume of the print drop. In a preferred embodiment of the present invention, the operating parameters of the deflection mechanism are constant for the predetermined print resolutions of multiple resolution continuous printing system 20. That is, in this preferred embodiment, the values of the operating parameters of the deflection mechanism are independent of which of the predetermined print resolutions is selected. Referring to FIG. 3, jetting module 48 includes an array or a plurality of nozzles 50. Liquid, for example, ink, supplied through channel 47, is emitted under pressure through each nozzle 50 of the array to form filaments of liquid 52. In FIG. 3, the array or plurality of nozzles 50 extends into and out of the figure.

Drop stimulation or drop forming device 28 (shown in FIGS. 1 and 2) associated with jetting module 48 is selectively actuated to perturb the filament of liquid 52 to induce portions of the filament to break off from the filament to form drops. In this way, drops are selectively created in the form of large drops and small drops that travel toward a recording medium 32.

Positive pressure gas flow structure 61 of gas flow deflection mechanism 60 is located on a first side of drop trajectory 57. Positive pressure gas flow structure 61 includes first gas flow duct 72 that includes a lower wall 74 and an upper wall 76. Gas flow duct 72 directs gas flow 62 supplied from a positive pressure source 92 at downward angle θ of approximately a 45° relative to liquid filament 52 toward drop deflection zone 64 (also shown in FIG. 2). An optional seal(s) 84 provides an air seal between jetting module 48 and upper wall 76 of gas flow duct 72.

Upper wall 76 of gas flow duct 72 does not need to extend to drop deflection zone 64 (as shown in FIG. 2). In FIG. 3, upper wall 76 ends at a wall 96 of jetting module 48. Wall 96 of jetting module 48 serves as a portion of upper wall 76 ending at drop deflection zone 64.

Negative pressure gas flow structure 63 of gas flow deflection mechanism 60 is located on a second side of drop trajectory 57. Negative pressure gas flow structure includes a second gas flow duct 78 located between catcher 42 and an upper wall 82 that exhausts gas flow from deflection zone 64. Second gas flow duct 78 is connected to a negative pressure source 94 that is used to help remove gas flowing through second gas flow duct 78. An optional seal(s) 84 provides an air seal between jetting module 48 and upper wall 82.

As shown in FIG. 3, gas flow deflection mechanism 60 includes positive pressure source 92 and negative pressure source 94. However, depending on the specific application contemplated, gas flow deflection mechanism 60 can include only one of positive pressure source 92 and negative pressure source 94.

Gas supplied by first gas flow duct 72 is directed into the drop deflection zone 64, where it causes large drops 56 to follow large drop trajectory 68 and small drops 54 to follow small drop trajectory 66. As shown in FIG. 3, small drop trajectory 66 is intercepted by a front face 90 of catcher 42. Small drops 54 contact front face 90 and flow down front face 90 and into a liquid return duct 86 located or formed between catcher 42 and a plate 88. Collected liquid is either recycled and returned to ink reservoir 40 (shown in FIG. 1) for reuse or discarded. Large drops 56 bypass catcher 42 and travel on to recording medium 32. Alternatively, deflection can be accomplished by applying heat asymmetrically to filament of liquid 52 using an asymmetric heater 51. When used in this capacity, asymmetric heater 51 typically operates as the drop forming mechanism in addition to the deflection mechanism. This type of drop formation and deflection is known having been described in, for example, U.S. Pat. No. 6,079,821 (Chwalek et al.).

As shown in FIG. 3, catcher 42 is a type of catcher commonly referred to as a "Coanda" catcher. However, the "knife edge" catcher shown in FIG. 1 and the "Coanda" catcher shown in FIG. 3 are interchangeable and work equally well. Alternatively, catcher 42 can be of any suitable design including, but not limited to, a porous face catcher, a delimited edge catcher, or combinations of any of those described above.

Figure 4:
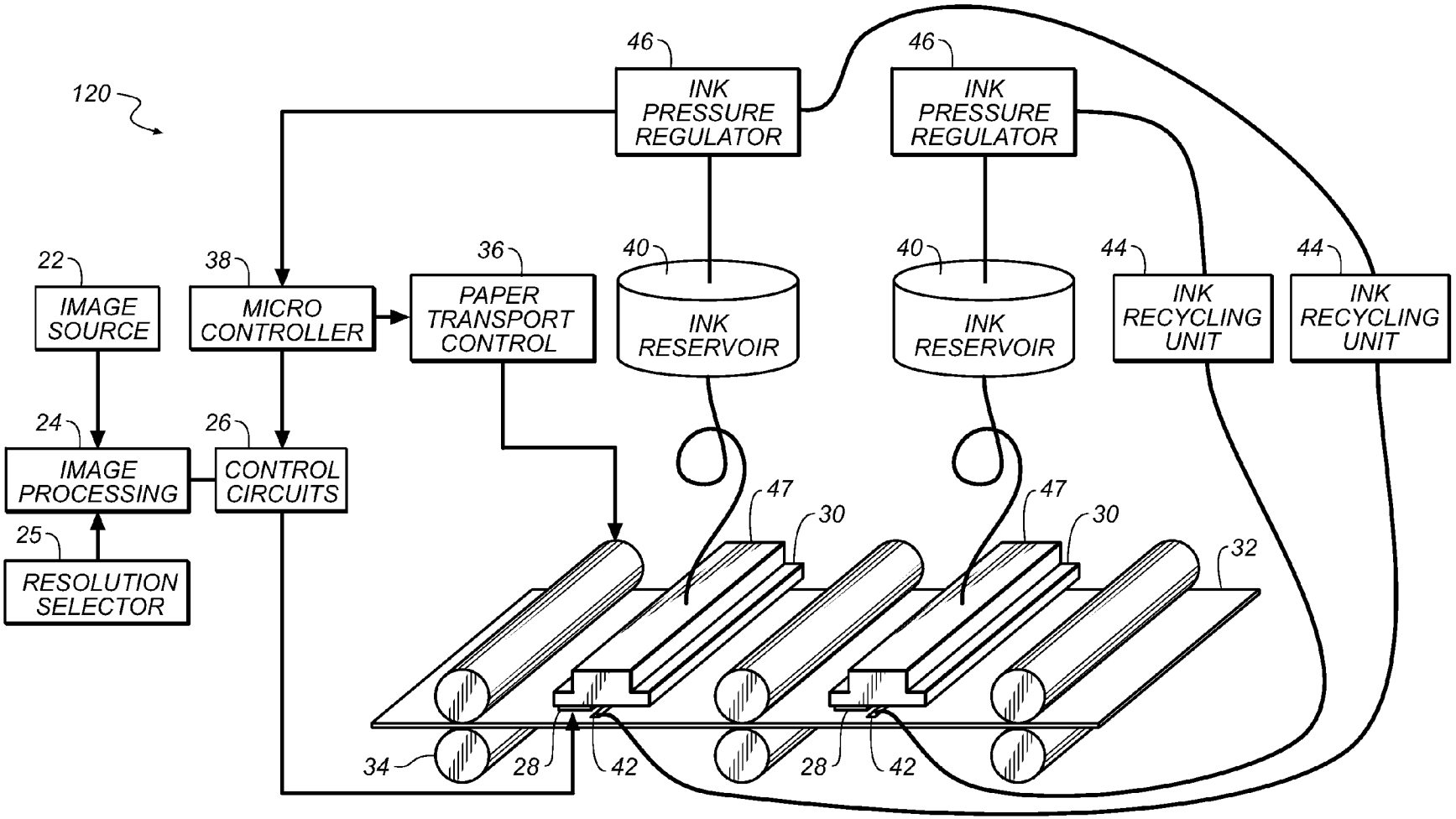
FIG. 4 shows a simplified schematic block diagram of an example embodiment of a printing system having two printheads made in accordance with the present invention.

FIG. 4 illustrates a multiple resolution continuous printing system 120 of the present invention which uses two printheads to obtain the range of predetermined resolutions. In this embodiment, the predetermined resolutions may differ in both the scan and array directions. As with multiple resolution continuous ink jet system 20 illustrated in FIG. 1, the system in FIG. 4 operates using predetermined resolutions having corresponding print drop volumes of $mV_0$. Similarly, the predetermined resolutions available have drop volumes with corresponding spot sizes which provide 100% fill and therefore high image quality at each resolution. As illustrated in FIG. 4, the multiple resolution continuous printing system 120 may have individual ink reservoirs 40 and ink recycling units 44 for each printhead 30. Alternatively, the multiple resolution continuous printing system 120 may have a single ink reservoir 40 and a single ink recycling unit 44 shared between the printheads 30 (not shown).

A greater understanding of generating drops of volumes $V_0$ and $mV_0$ can be gained by examining FIG. 2 and FIG. 5. Referring first back to FIG. 2, there is shown a filament of liquid 52 emitted from nozzle 50. This filament of liquid 52, or liquid jet, is emitted from a nozzle 50 supplied by a liquid held under high pressure in channel 47. The pressure in channel 47 is roughly equivalent to the ink pressure delivered to the printhead 30 by the ink reservoir 40 and ink pressure regulator 46, as illustrated in FIG. 1. The liquid 52 is emitted from nozzle 50 with a jet velocity, $v_{j0}$, the jet velocity depending on the delivered ink pressure. FIG. 2 illustrates the liquid stream 52 being controlled to break up into drops of predetermined volumes 54 and 56 at predetermined intervals, $\lambda_0$. A similar liquid stream to the one shown in FIG. 2 will break up into droplets after some distance of travel from the nozzle 50 without drop forming device 28 (not shown). An unperturbed liquid stream, or natural liquid jet, will naturally break up into drops of varying volume. As noted above, the physics of natural liquid jet break-up was analyzed in the late nineteenth century by Lord Rayleigh and other scientists. Lord Rayleigh explained that surface waves form on the liquid jet having spatial wavelengths, A, that are related to the diameter of the jet, $D_j$, that is nearly equal to the nozzle 30 diameter, $D_0$. These naturally occurring surface waves, $\lambda_n$ have lengths that are distributed over a range of approximately, $\pi D_j \leq \lambda_n \leq 10\pi D_j$.

Returning now to drops 54 and 56 of FIG. 2, as discussed above, the drop forming device 28 is a heater 51. Heater 51 is a resistive heater apparatus adapted to apply thermal energy pulses to the pressurized liquid passing through the nozzle 50. The filament of liquid 52 is caused to break up into a stream of drops of predetermined volume 54 and 56 by the application of thermal pulses that cause the launching of a dominant surface wave on the jet. The volume of drops 54 is $V_0 \approx \lambda_0 (\pi D_0^2/4)$, while the volume of drop 56 is a multiple of $V_0$, $mV_0$ where m is an integer greater than 1. To launch a stimulating surface wave of wavelength $\lambda_0$ the thermal pulses are introduced at a frequency $f_0 = v_{j0}/\lambda_0$, where $v_{j0}$ is the desired operating value of the liquid stream velocity. The period of the thermal stimulation pulses is $\tau_0 = 1/f_0$.

For the purpose of understanding the present inventions the jet diameter will be approximated by the diameter of nozzle 50, $D_0$, i.e. $D_j=D_0$. The jet diameter will be only a few percent smaller than the nozzle diameter for liquids having relatively low viscosities, i.e. v<20 centipoise. Further it is customary to relate the wavelength, $\lambda_0$, of surface waves to the jet diameter, $D_0$, using a dimensionless "wave ratio", L. In the explanation of the present invention herein, the dimensionless wave ratio, L, will be frequently used in place of the wavelength, $\lambda_0=L D_0$.

It is well known that surface waves having wave ratios less than $\pi$ have negative growth factors and so decay with time rather than grow to cause the jet to break up (reference Lord Rayleigh, -H. C. Lee, "Drop formation in a liquid jet," IBM Journal of Research and Development, July, 1974, pp. 364-369, and U.S. Pat. No. 7,249,829 issued to Hawkins et al.). The reported values for the optimum wave ratio ranges from $L_{opt}=\pi\sqrt{2}=4.443$ from a one-dimensional analysis by H. C. Lee (H. C. Lee, "Drop formation in a liquid jet," IBM Journal of Research and Development, July, 1974, pp. 364-369) to $L_{opt}=4.51$ determined from the more rigorous two-dimensional analysis by Lord Rayleigh. The growth factor rises quickly to its peak value from $\pi$ and then more slowly falls off as L increases. Surface waves having L values of 10 or more may still result in drop break off. However, if spontaneous waves having a smaller wave ratio (closer to the optimum wave ratio) are present with equal or larger initial amplitude, the smaller wave ratio waves will grow much faster and lead to earlier jet break-up. The practice of stimulating continuous ink jet requires that a perturbing surface wave is created on the continuous streams of liquid at a chosen wave ratio and with sufficient amplitude to overwhelm the spontaneous surface waves that would otherwise lead to natural break-up. Preferably, drop formation device 28 is operated to create drops of unit volume $V_0$ by creating perturbation surface waves on the continuous streams of liquid having a wave ratio $L_0$ between 4 and 7; and more preferably having wave ratio $L_0$ is between 4.4 and 4.6.

By reexamination of the drop volume equation, $V_0\approx\lambda_0(\pi D_0^2/4)$, in terms of L: $V_0\approx L(\pi D_0^3/4)$, one can see that in order to operate near the optimal wave ratio the selection of the nozzle diameter is limited by the desired drop volume. Since the print drops are integer (m) multiples of the fundamental drop volume, $mV_0$ the obtainable print drop volumes are then limited by the fundamental drop volume. The multiple resolution continuous printing system 20 is operated such that the predetermined print resolutions have corresponding print drop volumes, $mV_0$.

Figure 5A:
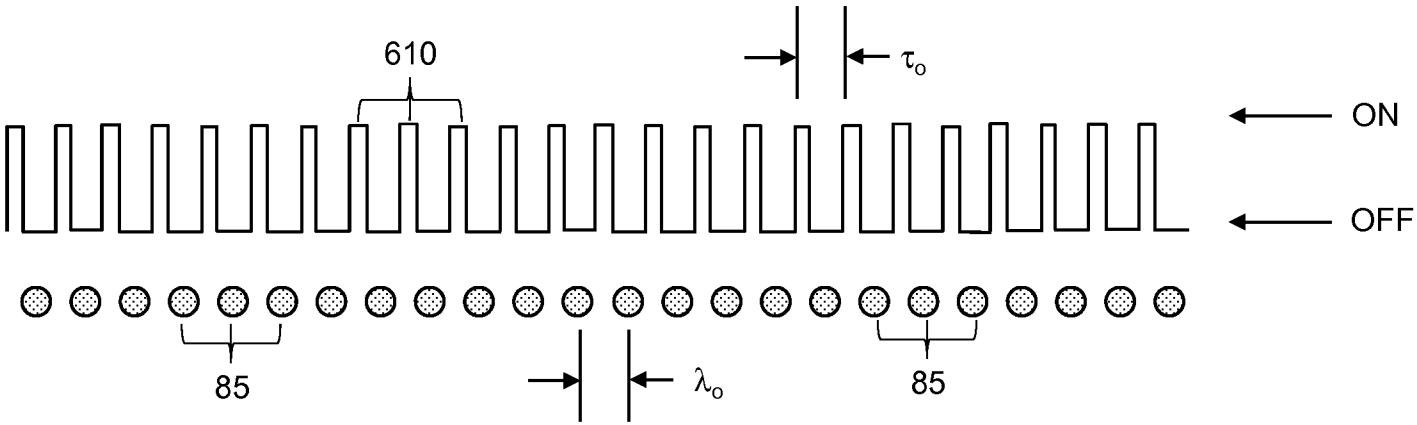
FIG. 5 illustrates a thermal stimulation pulse sequences that result in drops of predetermined unit volumes and multiples according to the present inventions.
Figure 5B:
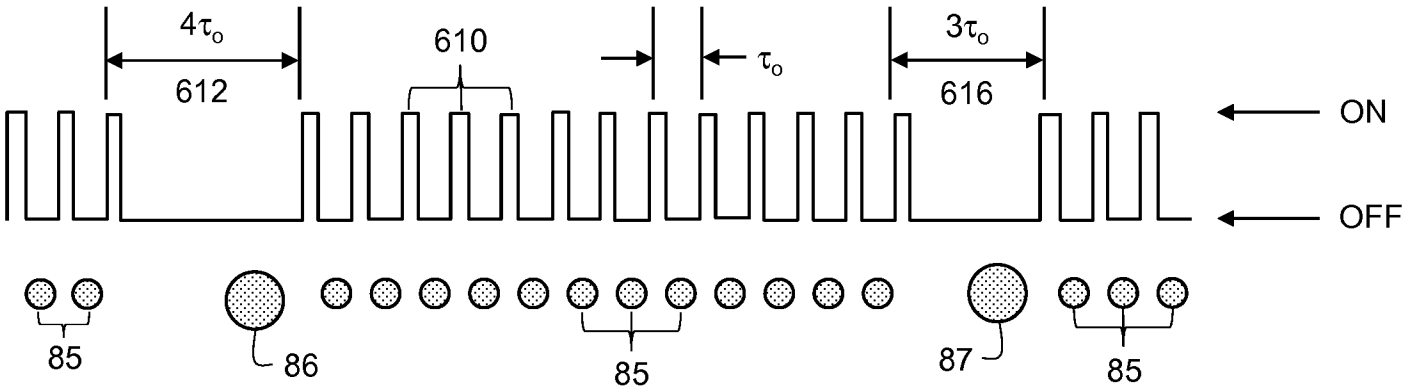

There are many stimulation schemes useful for creating drops 54 and 56. FIGS. 5*a* and 5*b* illustrate thermal stimulation of a continuous stream by several different sequences of electrical energy pulses resulting in drops having volumes that are multiples of the unit volume of drop 54. The energy pulse sequences are represented schematically as turning a heater resistor "on" and "off" at during unit periods, $\tau_0$.

Thermal pulse stimulation of the break-up of continuous liquid jets is known to provide the capability of generating streams of drops of predetermined volumes wherein some drops may be formed having volumes equal to $mV_0$, where m is an integer $V_0$ is the unit volume. Integer m is called the print drop ratio. For additional details, see for example, commonly-assigned U.S. Pat. No. 6,588,888 (Jeanmaire et al.). In FIG. 5*a* the stimulation pulse sequence consists of a train of unit period pulses 610. A continuous jet stream stimulated by this pulse train is caused to break-up into drops 54 all of volume $V_0$, spaced in time by a unit period $\tau_0$ and spaced along their flight path by $\lambda_0$. The energy pulse train illustrated in FIG. 5*b* consists of unit period pulses 610 plus the deletion of some pulses creating a $4\tau_0$ time period for sub-sequence 612 and a $3\tau_0$ time period for subsequence 616. The deletion of stimulation pulses causes the fluid in the jet to collect into drops of volumes consistent with these longer that unit time periods. That is, subsequence 612 results in the break-off of a drop 56 having volume $4V_0$ and subsequence 616 results in a drop 57 of volume $3V_0$. In practice, subsequences 612 and 610 would be used together when printing predetermined resolutions where m=4, and similarly subsequences 616 and 610 would be used when m=3.

As described in relationship to FIG. 1 and FIG. 4, multiple resolution continuous printing systems 20 and 120 contain a resolution selector 25 for selecting a print resolution for printing a document or a print job that includes a number of documents to be printed for a set of predetermined print resolutions. The print resolutions each define a two dimensional array of pixel locations. The pixel locations are equally spaced out in a first direction, which is parallel to the nozzle array. The pitch of the pixels locations along this direction is denoted herein as $R_{array}$. The pixel locations are also equally spaced in a second direction, perpendicular to the first direction. The pitch of the pixel locations in this direction is denoted herein as $R_{scan}$, as it is aligned with the primary scan direction or motion of the print media relative to the printhead. It is common to measure the pitch of the pixels in either direction in pixels per inch or dot [locations] per inch, dpi. The print resolutions can be symmetric or square resolutions in which the two components of the print resolution, in the array and the scan directions are equal, $R_{array}=R_{scan}$. Alternatively, the print resolutions are asymmetric in which the pixels spacing in the array direction is not equal to the pixel spacing in the scan direction, $R_{array}\neq R_{scan}$. For asymmetric print resolutions the ration of $R_{scan}/R_{array}$ is called the asymmetry ratio A. As the various predetermined print resolutions have different pixel spacings, the size of the dots to be printed at each pixel location to get complete coverage must vary for the different print resolutions. As used herein, "spot" and "dot" are synonymous and refer to a mark on the recording media. These predetermined print resolutions have corresponding print drop volumes $mV_0$. The print drops of $mV_0$ are therefore capable of delivering spots on the recording medium 32 that are of the correct size for each predetermined resolution. There are many ways to determine the necessary spot size for a given resolution. For "square" resolutions, which are print resolutions that have equal dots-per-inch (dpi or pixels-per-inch ppi) in the scan and array (printhead) directions, it is straightforward to calculate an appropriate spot size. As noted above, the appropriate spot size will leave no unwanted "white" space between the dots printed on adjacent pixels, including adjacent diagonal pixels.

Assuming that the spots are arranged on the page in a regular grid pattern, the center to center distance between each spot in both the scan and array directions is the corresponding pitch. In practice, it is useful to increase the 100% fill spot size by 10% to account for small errors in spot placement on the page. As such, a preferred spot size can be defined to guarantee covering the paper with 10% margin for spot placement error. A spot diameter $D_{spot}$ with 10% margin can be calculated for square resolutions (R) by $D_{spot}=1.1*\text{sqrt}(2)*25400/R$, where $D_{spot}$ is in microns and R is in dpi.

Figure 6C:
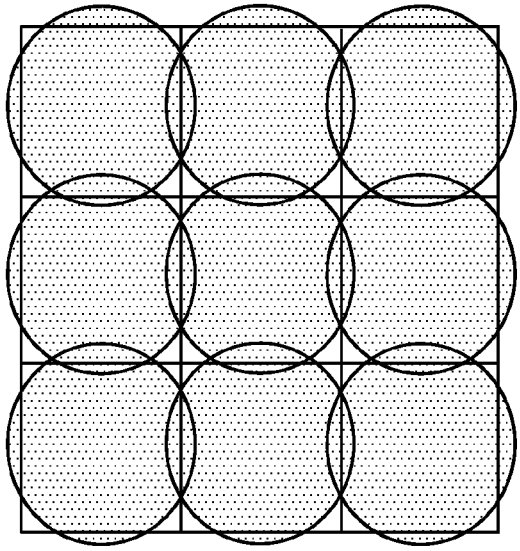
FIGS. 6*a*, 6*b*, and 6*c* illustrate ideal spot placement for (a) 100% fill spots, 6*b* 110% fill spots and 6*c* undersized spots resulting in unwanted "white" space.
Figure 6B:
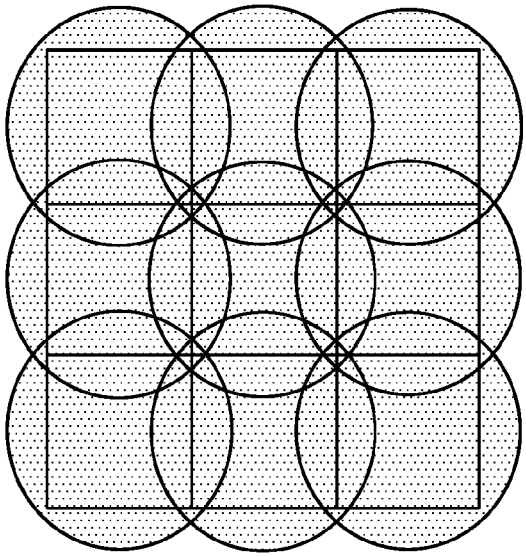
Figure 6A:
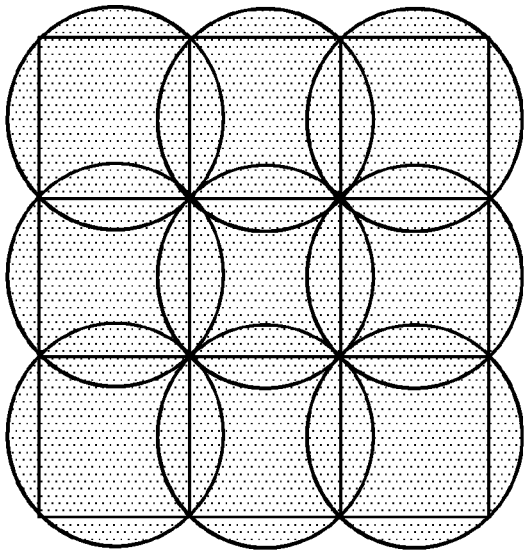

FIGS. 6*a*, 6*b*, and 6*c* illustrate the overlap of spots of different sizes as placed on a regular grid. FIG. 6*a* illustrates the 100% target spots of a 600×600 dpi printed image; as shown the spots each have a diameter of 59.87 microns and are placed ideally on the 42.33 micron (600 dpi) grid. As shown if FIG. 6*a*, the 100% spots meet at the corners of the grid. At 600×600 dpi with a 10% margin, the preferred spot diameter is 65.86 um; as shown in FIG. 6*b*, the 10% margin increases the overlap area between adjacent spots. For comparison purposes, spots with a diameter of 50 microns are shown in FIG. 6*c* on the same grid, illustrating unwanted "white" space with undersized spots.

For asymmetric resolutions that are less than a factor of two from square, it is not unreasonable to use the same logic as put forth for square resolutions. For example, a print resolution of 600×900 dpi using a 10% overfill criteria, the optimum spot size is 56 um, as calculated by $$D_{spot} = 1.1\sqrt{\left(\frac{25400}{R_{array}}\right)^2 + \left(\frac{25400}{R_{scan}}\right)^2}$$

where $R_{array}$ and $R_{scan}$ are the resolutions in the array and scan direction in units of dpi. This is simple modification to the $D_{spot}$ calculation allows for independent scan and array resolutions.

In addition to asymmetric resolutions, it is possible to devise printing schemes which purposely offset the spot placement of adjacent spots of some fraction of a pixel in either direction. For example, to reduce the effect of drop-drop interactions on the trajectory of a given drop, every other nozzle may be fired so that the drops on the page are offset by ½ a pixel in the scan direction, as described in commonly-assigned U.S. Pat. No. 7,758,171 (Brost). Also, in instances where multiple printheads are used to create an image, the relative spacing in the array direction may also be staggered by ½ pixel. Generally, in order to have complete coverage (no unwanted "white" space) for any regular arrangement of equally sized ink jet spots, the radius the 100% spot is defined as the circumcenter of the triangle formed by three adjacent spots.

In the instance where the spots are placed in a regular grid pattern as resolutions increase in asymmetry, using to $$D_{spot} = 1.1\sqrt{\left(\frac{25400}{R_{array}}\right)^2 + \left(\frac{25400}{R_{scan}}\right)^2}$$

calculate spot size overestimates the spot size necessary to give 100% fill on the page. Looking closely at the equation, it is clear that the minimum $D_{spot}$ is governed by the lowest resolution in the system—scan or array. For example, calculating a target spot size for a 600 npi printhead printing at 600 dpi in the array direction an optimum 10% overfill spot size of 46.6 microns is obtained as the $R_{scan}$ goes to infinity, and practically speaking a target spot size of 46.9 microns is calculated for Rscan=4800 dpi. For resolutions with asymmetry ratio, $A=R_{scan}/R_{array}$, greater than or equal to 2, the simple calculation for $D_{spot}$ is only valid when a print is made in a manner that allows one drop to fully dry and form a spot on the page prior to deposition of the next drop, and if the next drop does not interact with the ink already on the page. One can think about this as if each spot on the page was placed as sticker, where the boundary of the ink (ie sticker size) is fixed by the drop volume. It is worth noting that for other printing technologies, such as offset lithography, the sticker analogy holds.

In ink jet printing, and particularly for single printhead printing, as the scan resolution increases for a fixed array resolution ($R_{array}$), the likelihood that a subsequent drop will land on the previous drop while it is still wet on the surface of the recording media increases. It has been found that for resolutions that are a factor of two or more from square (A>2), it is likely that the print drops from two adjacent pixels will merge to form a single spot on the recording media. From this observation, one can view the resolution of a 100% filled area to be the square resolution. As an example, when printing a 600 dpi by 1200 dpi image with a printhead 30 that has 600 nozzles per inch (npi), 100% fill areas can be considered to be 600 dpi by 600 dpi. It is known that for a square resolution 600 dpi image the spot size should be approximately 65.9 microns in diameter on the recording media. Therefore the size of the merged spot formed by 2 print drops, in this example, should also be 65.9 um in diameter. This concept may be generalized for resolutions where A≤2. Generally, a predetermined resolution with $R_{array}$ equal to the npi and $R_{scan}$ equal to the integer multiple A of the $R_{array}$ can be expressed as $R_{array}\times R_{array}*A$, where A is the asymmetry ratio and is equal to the number of drops that will form the $R_{array}\times R_{array}$ required spot size.

The diameter of the final spot on the page is highly dependent on ink-media interactions. It is therefore, best to determine the optimum print drop volume using two empirical models: 1) the asymmetry (A) correlation of a single print spot ($mV_0$) to merged spot sizes as printed at the corresponding resolutions ($A*mV_0$), printed at $R_{array}\times R_{array}*A$) and 2) a print spot $D_{spot}$ to drop volume ($mV_0$) correlation. It has been found that an empirical model to determine merged spot sized based normalized drop diameter ratios is valid for multiple drop volumes ($mV_0$).

As noted above, to form the appropriate sized spot for a $R_{array}\times R_{array}*A$ resolution, A print drops merge on the page. The volume of ink which forms each merged spot is therefore A times the print drop volume. A theoretical print drop can be imagined which represents the collection of A drops, and has a volume of A times print drop volume ($A*mV_0$). The diameter of the actual and theoretical print drops can be calculated. Since the volume of the theoretical print drops scales with A, an effective drop diameter ratio (EDDR) can be determined for any value of A by taking the ratio of a drop of $A*mV_0$ to a single print drop ($mV_0$). This ratio results the simple relationship of $EDDR=A^{1/3}$.

Figure 7:
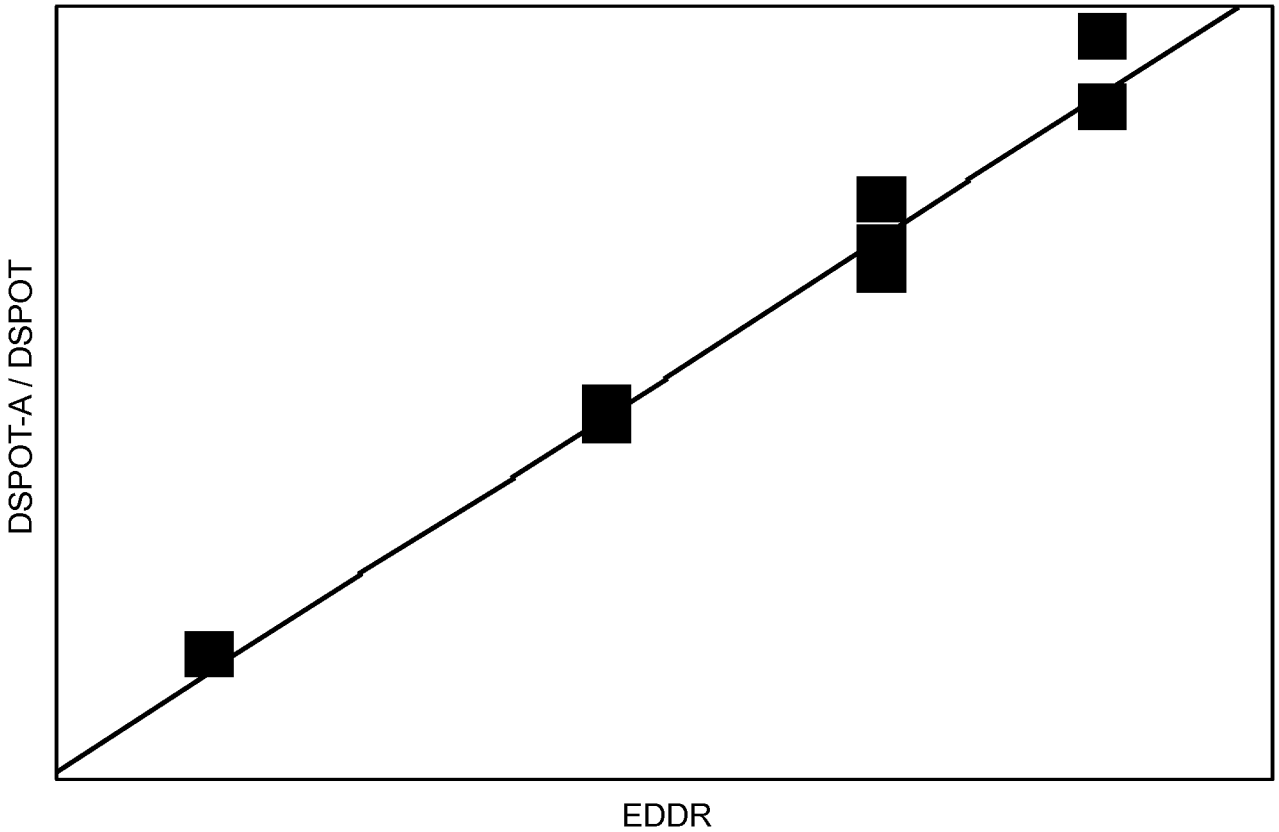
FIG. 7 illustrates a representative correlation of $D_{spot\text{-}A}/D_{spot}$ to EDDR useful in determining target drop sizes for asymmetric resolutions.

To validate the spot size determination for asymmetric resolutions where A≥2, a series of prints were made using both pigmented ink and dye based ink on a single batch of a glossy coated paper. (The glossy coated paper yields a more consistent dot size and shape and uncoated papers.) A 600 npi head was used to print images which contained single pixel spots, as well as spots formed with A number of drops/pixels (2 drops/pixels for 1200 dpi, etc). The diameters of the single spots ($D_{spot}$) and the A spots ($D_{spot-A}$) were measured using a hand-held CCD device from Quality Engineering Associates, Inc. (QEA) and associated software. The ratio of the $D_{spot-A}$ to $D_{spot}$ was taken over a range of drop volumes ($mV_0$) and $R_{scan}$. These ratios were correlated to the EDDR and found to have a single straight-line correlation, as shown in FIG. 7. This correlation can be used to determine the target spot size $D_{spot}$ for resolutions where A≥2, since it was previously determined that $D_{spot-A}$ is equivalent to the $D_{spot}$ target for where $R=R_{array}$. As used herein, the $D_{spot-A}$ is the fill spot diameter.

Figure 8B:
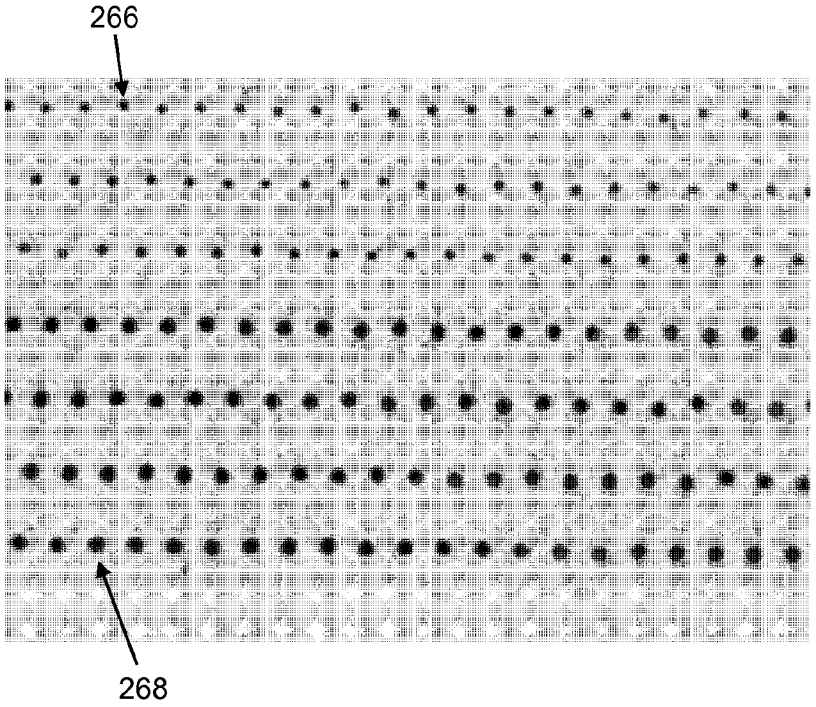
FIGS. 8*a* and 8*b* illustrate spots from single print drops and multiple drop merged spots on the recording media for 600×1200 dpi and 600×1800 dpi prints.
Figure 8A:
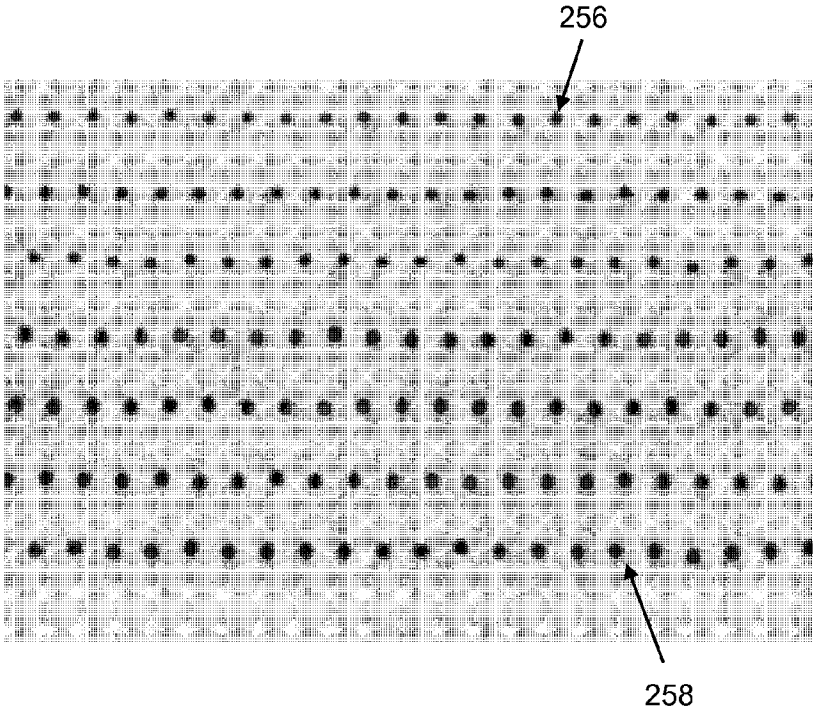
Figure 9:
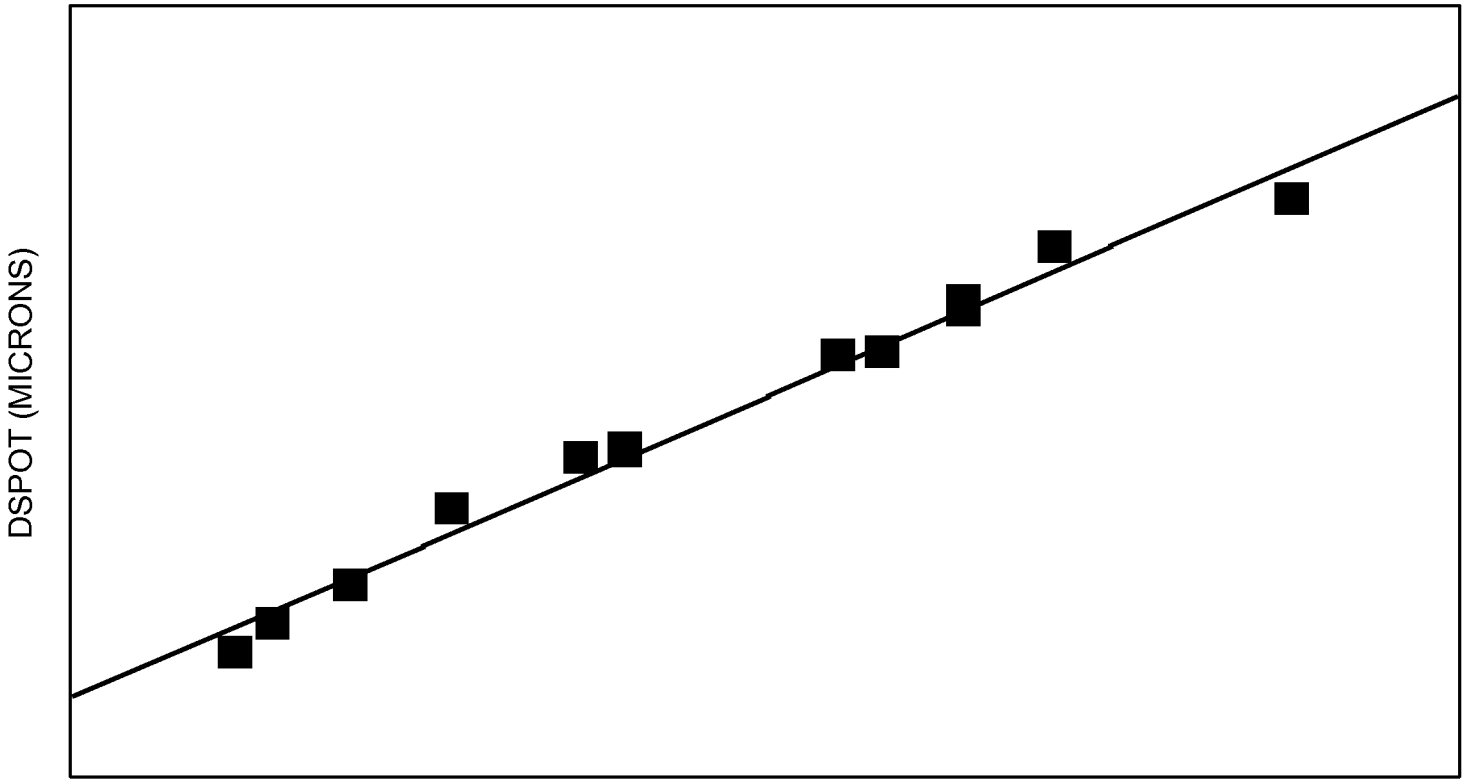
FIG. 9 illustrates a representative correlation of $D_{spot}$ to $mV_0$ useful in determining target drop volumes.

FIGS. 8*a* and 8*b* illustrate the spots generated by single drops and merged drops, from a 600 npi printhead, at 600×1200 dpi (A=2) and 600×1800 dpi (A=3) respectively. In FIG. 8*a* spots 256 were formed by a single drop, while spots 258 were each formed by two consecutive drops placed 21.17 microns apart in the scan direction. In FIG. 8*b* spots 266 were formed by a single drop, while spots 268 were each formed by three consecutive drops placed 14.11 microns apart in the scan direction. In both cases, clearly drops have merged to form a single merge spot on the recording media in the case of spots 258 and 268.

The second step in determining the target drop volume ($mV_0$) is correlation of drop volume to spot size ($D_{spot}$). FIG.

9 illustrates a typical correlation of $mV_0$ to $D_{spot}$. Generally it has been found that over the range of $D_{spot}$ of interest a linear correlation is sufficient, however for greater accuracy power law, cubic or other relationships maybe used.

The methods presented herein for determining the desired spot size on the media are intended to serve as examples useful in the present invention, and are not intended to be limiting. Other methods for determining the desired spot size, and corresponding drop volume are also valid under the current invention as long as each predetermined resolution has a corresponding drop volume $mV_0$, where m is an integer between 2 and 10, and preferably if the spot size for each predetermined resolution results in 100% fill areas with no unwanted "white" space on the recording media and The maximum paper speed of ink jet systems is fixed by the frequency of the print drop formation and the resolution in the scan direction. $R_{scan}$ sets the number of print drops (spots) on the page per inch in the media advance (scan) direction, while the print frequency sets how fast those drops can be generated. The maximum paper speed for any given print frequency ($F_p$) and scan resolution ($R_{scan}$) can be determined using the relationship $PaperSpeed_{max}=F_p/R_{scan}$. The print frequency is the frequency associated with making print drops $mV_0$, and is therefore the fundamental frequency divided by the print drop ratio m ($F_p=f_0/m$). For a fixed $R_{array}$, images with larger $R_{scan}$ values will have a lower maximum print speed for a given print drop ratio (m). Similarly images printed at the same resolution but with larger values of m will have a lower print frequency and therefore a slower maximum print speed than their lower print drop ratio counterparts. Multiple resolution continuous ink jet printing system will present users with the option to tradeoff print speed and resolution depending on the requirements of a given print job. Printing selected higher resolutions with the multiple resolution continuous printing system 20, the system runs at a lower maximum print speed, but gives higher image quality with lower grain. Conversely, at lower resolutions, higher print speeds are obtainable with higher grain and fewer obtainable gray levels. This allows the user to determine which factor is important on a job by job basis, rather that having to choose a system preconfigured for one condition. The $R_{scan}$ and process speed are independently controllable up to the limit of $PaperSpeed_{max}$. The multiple resolution continuous ink jet printing system may be operated at different process speeds for different resolutions, or may optionally fix the process speed for a given job (a job represents a collection of documents printed together) such that all system resolutions are obtainable. Similarly, the selected operating resolution may vary job-to-job, image-to-image, or within an image. That is, different ones of the predetermined print resolutions can be selected for different print jobs, for different documents within a print job, or for different portions of a document.

The multiple resolution continuous printing system 120 utilizing two printheads had additional range in quality and speed, since the system may be operated such that each printhead is effectively doubling the maximum print speed over a single printhead system. Alternatively, the two printhead system may be used to create images at higher resolution in the array direction at slower speeds.

The following examples are presented as further understandings of the present invention and are not to be construed as limitations thereon.

Example 1

In this example a series of prints were made on glossy paper using a 600 npi printhead at resolutions of 600×900, 600×1200 and 600×2400. The printhead used in this example had a nominal nozzle diameter $D_0$ of 8 microns, and was operated at a nominal jet velocity of 20 m/s. The frequency for forming the fundamental drop $V_0$ was 451 kHz, resulting in a value of L of 5.7 and a drop volume $V_0$ of 2.3 pL. Quality images were obtained with equivalent 100% fill at all three resolutions. The drop volumes used to image the three resolutions of 600×900 dpi, 600×1200 dpi and 600×2400 dpi were produced at values of m of 4, 3 and 2 respectively. Where Rscan=1200, A=2 and when Rscan=2400, A=4 consistent with the previous discussion, the $D_{spot-A}$ was set to be equivalent to the $D_{spot}$ for the $R_{array}\times R_{array}$ image of 600×600 dpi. In this example the operation conditions of the deflection mechanism were different for each printed resolution. Table 1 summarizes the results from Example 1.

TABLE 1

| $R_{array}$ (dpi) | $R_{scan}$ (dpi) | $f_0$ (kHz) | m | Print Drop Volume (pl) | A | Fill Spot Diameter Target (microns) | Fill Spot Diameter Measured (microns) | % Difference in Fill Spot Size | Paper Speed (fpm) | Air Flow Neg. (fpm) | Air Flow Positive (fpm) |
|---|---|---|---|---|---|---|---|---|---|---|---|
| 600 | 900 | 450 | 4 | 9.2 | n/a | 56.0 | 57.1 | 2.0% | 200 | 1050 | 1620 |
| 600 | 1200 | 450 | 3 | 6.9 | 2 | 65.9 | 66.3 | 0.7% | 200 | 1070 | 1670 |
| 600 | 2400 | 450 | 2 | 4.6 | 4 | 65.9 | 68.8 | 4.5% | 200 | 1045 | 1525 |

Example 2

The multiple resolution continuous printing system of Example 2 is similar to that of Example 1, except that the operating parameters of the deflection mechanism were kept the same for each of the print resolutions. The quality of the images and the values for the fill spot diameter were equivalent to Example 1. The deflection control mechanism was run at a negative air flow of 1050 and a positive air flow of 1650 for the same three resolutions as Example 1. In this example, the operating parameter values are kept the same for each of the selectable predetermined print resolutions. In both the first and second examples, the same jet velocity, $vj_0$, is employed for each of the selectable predetermined print resolutions.

Theoretical Example 1

Table 1 contains details for four model multiple resolution continuous ink jet systems, A-D. All four systems A-D are designed to operated at an optimal wave ratio for the fundamental drop of L=4.5, and with a common jet velocity $v_{j0}$. The systems of Table 1 are intended to be operated in single pass mode, where each color is addressed by a single array of nozzles. These four system models each provide three or four selectable predetermined print resolutions each of which has a corresponding print drop volume $mV_0$ with a distinct value of the print drop ratio m, with the values of the print drop ratio m are integers that are greater than 1 and less than 7. As can be seen in Table 2, the print resolutions have asymmetry ratios $A=R_{scan}/R_{array}$ of 1, 1.5, 2, 3, and 4. That is, the predetermined print resolutions have asymmetry ratios A, where A is 1.5 or an integer greater than or equal to 1.

TABLE 2

Example systems for single pass printing

| ID | DPI array | DPI paper | Target $D_{spot}$ (microns) | Predicted Dspot (microns) | $mV_0$ (pL) | $V_0$ (pL) | $D_0$ (microns) | L | m | $f_0$ (kHz) | MAX Paper Speed (ft/min) | % Difference in Spot size from Target |
|---|---|---|---|---|---|---|---|---|---|---|---|---|
| A | 600 | 600 | 65.86 | 64.48 | 10.96 | 1.83 | 8.02 | 4.50 | 6 | 553.84 | 769 | −2.1% |
| A | 600 | 900 | 55.97 | 55.97 | 9.13 | 1.83 | 8.02 | 4.50 | 5 | 553.84 | 615 | 0.0% |
| A | 600 | 1200 | 47.65 | 48.18 | 7.31 | 1.83 | 8.02 | 4.50 | 4 | 553.84 | 577 | 1.1% |
| A | 600 | 1800 | 39.97 | 40.04 | 5.48 | 1.83 | 8.02 | 4.50 | 3 | 553.84 | 513 | 0.2% |
| B | 600 | 900 | 55.97 | 54.36 | 8.69 | 1.45 | 7.43 | 4.50 | 6 | 598.35 | 554 | −2.9% |
| B | 600 | 1200 | 47.65 | 47.90 | 7.24 | 1.45 | 7.43 | 4.50 | 5 | 598.35 | 499 | 0.5% |
| B | 600 | 1800 | 39.97 | 41.44 | 5.79 | 1.45 | 7.43 | 4.50 | 4 | 598.35 | 416 | 3.7% |
| B | 600 | 2400 | 35.43 | 34.98 | 4.35 | 1.45 | 7.43 | 4.50 | 3 | 598.35 | 416 | −1.3% |
| C | 600 | 900 | 55.97 | 55.95 | 9.05 | 1.81 | 8.00 | 4.50 | 5 | 555.58 | 617 | 0.0% |
| C | 600 | 1200 | 47.65 | 47.88 | 7.24 | 1.81 | 8.00 | 4.50 | 4 | 555.58 | 579 | 0.5% |
| C | 600 | 1800 | 39.97 | 39.81 | 5.43 | 1.81 | 8.00 | 4.50 | 3 | 555.58 | 514 | −0.4% |
| D | 600 | 600 | 65.86 | 66.53 | 11.42 | 2.28 | 8.65 | 4.50 | 5 | 514.11 | 857 | 1.0% |
| D | 600 | 900 | 55.97 | 55.97 | 9.13 | 2.28 | 8.65 | 4.50 | 4 | 514.11 | 714 | 0.0% |
| D | 600 | 1200 | 47.65 | 46.15 | 6.85 | 2.28 | 8.65 | 4.50 | 3 | 514.11 | 714 | −3.1% |
| D | 600 | 2400 | 35.43 | 35.97 | 4.57 | 2.28 | 8.65 | 4.50 | 2 | 514.11 | 536 | 1.5% |

Theoretical Example 2

Table 3 contains details for two model multiple resolution continuous ink jet systems operating with two printheads. Both systems E and F are designed to operated at an optimal wave ratio of L=4.5.

TABLE 3

Example systems design using 2 printheads

| ID | DPI array | DPI paper | Target $D_{spot}$ (microns) | Predicted Dspot (microns) | $mV_0$ (pL) | $V_0$ (pL) | $D_0$ (microns) | L | m | $f_0$ (kHz) | MAX Paper Speed (ft/min) | % Difference in Spot size from Target |
|---|---|---|---|---|---|---|---|---|---|---|---|---|
| E | 600 | 900 | 55.97 | 56.86 | 9.25 | 1.85 | 8.06 | 4.50 | 5 | 551.48 | 1226 | 1.6% |
| E | 600 | 1200 | 47.65 | 48.60 | 7.40 | 1.85 | 8.06 | 4.50 | 4 | 551.48 | 1149 | 2.0% |
| E | 600 | 1800 | 39.97 | 40.35 | 5.55 | 1.85 | 8.06 | 4.50 | 3 | 551.48 | 1021 | 1.0% |
| E | 1200 | 1200 | 32.93 | 32.10 | 3.70 | 1.85 | 8.06 | 4.50 | 2 | 551.48 | 1149 | −2.5% |
| F | 900 | 1800 | 31.80 | 31.65 | 3.60 | 0.90 | 6.34 | 4.50 | 4 | 701.19 | 974 | −0.5% |
| F | 900 | 2700 | 26.60 | 27.64 | 2.70 | 0.90 | 6.34 | 4.50 | 3 | 701.19 | 866 | 3.9% |
| F | 1800 | 1800 | 23.60 | 23.62 | 1.80 | 0.90 | 6.34 | 4.50 | 2 | 701.19 | 974 | 0.1% |

The invention has been described in detail with particular reference to certain preferred embodiments thereof, but it will be understood that variations and modifications can be effected within the scope of the invention.

PARTS LIST

20 multiple resolution continuous printer system
22 image source
24 image processing unit
25 resolution selector
26 mechanism control circuits
28 drop forming device
30 printhead
32 recording medium
34 recording medium transport system
36 recording medium transport control system
38 micro-controller
40 reservoir
42 catcher
44 recycling unit
46 ink pressure regulator
47 channel
48 jetting module
49 nozzle plate
50 nozzle
51 heater
52 liquid
54 drops
56 drops
57 trajectory
58 drop stream
60 gas flow deflection mechanism
61 positive pressure gas flow structure
62 gas flow
63 negative pressure gas flow structure
64 deflection zone
66 small drop trajectory
68 large drop trajectory
72 first gas flow duct
74 lower wall
76 upper wall
78 second gas flow duct
82 upper wall
84 optional seal
86 liquid return duct
88 plate
90 front face
92 positive pressure source
94 negative pressure source
96 wall
120 multiple resolution continuous ink jet system

256 spot formed from a single drop
266 spot formed from a single drop
258 spot formed from two merged drops
268 spot formed from three merged drops
610 representation of stimulation thermal pulses for drops 85
612 representation of deleted stimulation thermal pulses for drop 86
616 representation of deleted stimulation thermal pulses for drop 87

The invention claimed is:

1. A continuous ink jet printing system capable of printing at multiple predetermined print resolutions comprising:

a) a drop generator having an array of nozzles for emitting a plurality of continuous streams of liquid for applying ink to media driven in a media advance direction having:
   i) a source for pressurized liquid for supplying pressurized liquid to the plurality of nozzles; and
   ii) a stimulation device associated with each nozzle of the array of nozzles for forming ink drops having predetermined drop volumes from the continuous streams of liquid, wherein the predetermined drop volumes include non-print drops of a unit volume $V_0$, and print drops having volumes $mV_0$, wherein the print drop ratio m is an integer greater than 1;

b) a catcher to collect the non-print drops; and c) a selector for selecting a predetermined print resolution, wherein each predetermined print resolution has a corresponding print drop volume $mV_0$ with a distinct value of the print drop ratio m.

2. The system of claim 1 wherein the array of nozzles is a linear array having an effective number of nozzles per inch (npi).

3. The system of claim 2 wherein the predetermined print resolutions include resolutions with asymmetry ratios $A=R_{scan}/R_{array}$, where A is 1.5 or an integer greater than or equal to 1.

4. The system of claim 2 having N number drop generators each having an array of nozzles for emitting a plurality of continuous streams of liquid and each capable of addressing pixels in array direction, where N is an integer greater than 1.

5. The system of claim 4 wherein the $R_{array}$ equivalent to the array npi and scan resolutions $R_{scan}$ in the media advance direction which are multiples of $R_{array}$ such that $R_{scan}=A*R_{array}$, where A is 1.5 or an integer greater than or equal to 1.

6. The system of claim 2 wherein the predetermined print resolutions include resolutions with the array resolution $R_{array}$ equivalent to the array npi and array resolutions of $R_{array}=N*npi$.

7. The system of claim 2 wherein the array of nozzles extend in an array direction.

8. The system of claim 1 wherein different ones of the predetermined print resolutions can be selected for different portions of a document.

9. The system of claim 1 wherein the print drop volumes for each of the predetermined print resolutions have volume multiples m that are greater than 1 and less than 7.

10. The system of claim 1 wherein a deflection mechanism deflects non-print drops to the catcher.

11. The system of claim 10 wherein the deflection mechanism has one or more operating parameters that have values and the one or more operating parameters value are the same for each of the selectable predetermined print resolutions.

12. The system of claim 1 where the $mV_0$ associated with each predetermined print resolution produces a spot on the media with a diameter $D_{spot}$ that when printing a solid fill image area there is less that 2% unwanted "white" space.

13. The system of claim 1 where $mV_0$ associated with each predetermined print resolution produces a spot on the media with a diameter $D_{spot}$ that produces a solid fill image with no unwanted "white" space.

14. The system of claim 1 wherein the drop formation device is operated to create the drops of unit volume $V_0$ by creating perturbation surface waves on the continuous streams of liquid having a wave ratio $L_0$ between 4 and 7.

15. The system of claim 13 wherein the drop formation device is operated to create the drops of unit volume V0 by creating perturbation surface waves on the continuous streams of liquid having a wave ratio $L_0$ between 4.4 and 4.6.

16. The system of claim 1 wherein different ones of the predetermined print resolutions can be selected for different print jobs.

17. The system of claim 1 wherein different ones of the predetermined print resolutions can be selected for different documents within a print job.

18. The system of claim 1 wherein the continuous streams of liquid have a stream velocity $vj_0$.

19. The system of claim 18 wherein the same stream velocity is employed for each of the selectable predetermined print resolutions.

* * * * *